US010035625B2

(12) United States Patent
Greco et al.

(10) Patent No.: US 10,035,625 B2
(45) **Date of Patent: *Jul. 31, 2018**

(54) WIDE MOUTH GUSSETED POUCHES

(71) Applicant: ILLINOIS TOOL WORKS INC., Glenview, IL (US)

(72) Inventors: Charles G. Greco, Bardonia, NY (US); Steven Ausnit, New York, NY (US)

(73) Assignee: ILLINOIS TOOL WORKS INC., Glenview, IL (US)

( * ) Notice: Subject to any disclaimer, the term of this patent is extended or adjusted under 35 U.S.C. 154(b) by 0 days.

This patent is subject to a terminal disclaimer.

(21) Appl. No.: 15/664,392

(22) Filed: Jul. 31, 2017

(65) Prior Publication Data

US 2017/0327275 A1 Nov. 16, 2017

Related U.S. Application Data

(63) Continuation of application No. 11/429,555, filed on May 5, 2006, now Pat. No. 9,745,103.

(51) Int. Cl.
*B65D 30/20* (2006.01)
*B65D 33/25* (2006.01)

(52) U.S. Cl.
CPC ..... *B65D 31/10* (2013.01); *B65D 33/2508* (2013.01); *B65D 33/2541* (2013.01)

(58) Field of Classification Search
CPC . B65D 31/10; B65D 33/2508; B65D 33/2541
USPC ..... 383/63
See application file for complete search history.

(56) References Cited

U.S. PATENT DOCUMENTS

| | | | |
|---|---|---|---|
| 2,499,898 | A | 3/1950 | Anderson |
| 3,263,903 | A | 8/1966 | Waller et al. |
| 3,557,413 | A | 1/1971 | Engle |
| 4,024,003 | A | 5/1977 | Buhler |
| 4,290,174 | A | 9/1981 | Kalleberg |
| 4,322,875 | A | 4/1982 | Brown et al. |
| 4,332,344 | A | 6/1982 | Strodthoff |
| 4,655,862 | A | 4/1987 | Christoff et al. |
| 4,736,450 | A | 4/1988 | Van Erden et al. |
| 4,792,240 | A | 12/1988 | Ausnit |
| 4,844,759 | A | 7/1989 | Boeckmann |
| 5,037,138 | A | 8/1991 | McClintock et al. |
| 5,040,275 | A | 8/1991 | Eckhardt et al. |

(Continued)

FOREIGN PATENT DOCUMENTS

| | | |
|---|---|---|
| FR | 2816597 | 5/2002 |
| JP | 3355425 | 12/2002 |
| JP | 4546061 | 9/2010 |

OTHER PUBLICATIONS

International Search Report issued in PCT/US2007/008047.

*Primary Examiner* — Peter Helvey
(74) *Attorney, Agent, or Firm* — McCarter & English, LLP

(57) ABSTRACT

A reclosable gusseted bag is disclosed wherein a single web multiple alignment zipper is placed around the interior of the mouth of the bag, downwardly adjacent from the upper edge of the front panel, rear panel and side gussets thereby resulting in an increased size of opening as the mouth of the gusseted bag. The use of a single web multiple alignment zipper allows opposing portions of the web to engage each other within a range of alignments thereby allowing for simplified use by the consumer.

15 Claims, 3 Drawing Sheets

(56) References Cited

U.S. PATENT DOCUMENTS 5,140,727 A 8/1992 Dais et al.
5,307,552 A 5/1994 Dais et al.
5,833,058 A 11/1998 Mabry
5,836,444 A 11/1998 Hoevel et al.
5,878,468 A 3/1999 Tomic et al.
5,902,427 A 5/1999 Zinke et al.
5,933,927 A 8/1999 Miller et al.
6,076,238 A 6/2000 Arsenault et al.
6,079,184 A 6/2000 Cassou et al.
6,186,663 B1 2/2001 Ausnit
6,231,236 B1 5/2001 Tilman
6,325,543 B1 12/2001 Ausnit
6,393,804 B1 5/2002 Ausnit
6,398,412 B2 6/2002 Wedi et al.
6,519,917 B2 2/2003 Forman
6,533,456 B1 3/2003 Buchman
6,572,267 B1 6/2003 Forman
6,687,962 B2 2/2004 Clarner et al.
6,719,140 B1 4/2004 Rinsler
6,786,712 B2 9/2004 Cisek
6,820,391 B2 11/2004 Barmore
6,953,542 B2 10/2005 Cisek
6,959,826 B2 11/2005 Knuth et al.
6,971,794 B2 12/2005 Yeager
7,007,351 B2 3/2006 Ausen et al.
7,163,338 B2 1/2007 McCracken et al.
7,223,017 B2 5/2007 Weaver
7,340,807 B2 3/2008 Dais et al.
7,635,222 B2 12/2009 Plourde et al.
8,033,974 B2 * 10/2011 Yeager ..... B65D 31/10 493/213
8,182,407 B2 * 5/2012 Yeager ..... B65D 31/10 493/210
8,360,643 B2 * 1/2013 Komro ..... B65D 75/5855 383/111
8,690,046 B2 * 4/2014 Plourde ..... B65D 33/24 229/125.015
8,695,793 B2 * 4/2014 Saggar ..... B65D 33/007 206/233
9,315,299 B2 * 4/2016 Yeager ..... B65D 33/1658
2001/0012414 A1 8/2001 Price
2001/0051008 A1 12/2001 Wedi et al.
2002/0062925 A1 5/2002 Ausnit
2002/0168120 A1 11/2002 Wessling et al.
2002/0186120 A1 12/2002 Tamura et al.
2003/0063820 A1 4/2003 Buchman
2003/0101552 A1 6/2003 Plourde et al.
2003/0163110 A1 8/2003 Lecointe
2003/0210838 A1 11/2003 Steele
2004/0146224 A1 7/2004 Piotrowski et al.
2004/0208402 A1 10/2004 Yeager
2004/0247208 A1 12/2004 Krohne
2005/0040127 A1 2/2005 Knuth et al.
2005/0053315 A1 3/2005 Aasen
2005/0262810 A9 12/2005 McMahon et al.
2006/0021296 A1 2/2006 Yeager
2006/0230588 A1 10/2006 Sprehe
2008/0008406 A1 1/2008 Russell
2008/0069820 A1 3/2008 Fuh et al.
2010/0202714 A1 8/2010 Koenigkramer

* cited by examiner

WIDE MOUTH GUSSETED POUCHES

This application is a Continuation Application of U.S. application Ser. No. 11/429,555, filed on May 5, 2006, the contents of which is hereby incorporated by reference in its entirety and for all purposes.

BACKGROUND OF THE INVENTION

Field of the Invention

The present invention relates to a reclosable zippered gusseted pouch with a multi-track, variable-alignment zipper placed within the perimeter of its film walls. As the gussets and bag walls behind the multi-track zipper are pressed together, the zipper tracks interlock in the area of both the gussets and bag walls.

Description of the Prior Art

In the prior art, it is well-known to use gusseted packages in order to create a free-standing package with increased volumetric capacity. While these packages have been satisfactory for their intended purposes in many respects, they typically have had their gussets sealed together so that only the front panel opened for access to the contents of the package. Smaller sized gusseted bags are particularly problematic in this respect.

OBJECTS AND SUMMARY OF THE INVENTION

It is therefore an object of the present invention to provide a gusseted container which achieves a large opening for dispensing of products therefrom.

It is therefore an object of the present invention to provide a gusseted container which achieves the above object with a manufacturing process which is relatively simple and economical.

These and other objects are attained by providing a gusseted pouch or reclosable container with a single web multiple-alignment zipper within the internal perimeter of the mouth thereof. This causes the gussets to close on both the front and back panels. By pulling apart the front and rear panels, the zipper will release the gussets thereby giving the pouch an opening equal to the internal diameter of the film forming the pouch walls.

The use of a single web multiple alignment zipper reduces the production costs of this container.

Such a container will increase the consumer's access to the contents of the package. Such a container can be applied to many markets, such as, but not limited to, cookies, snack foods and pet foods.

BRIEF DESCRIPTION OF THE DRAWINGS

Further objects and advantages of the invention will become apparent from the following description and from the accompanying drawings, wherein.

DETAILED DESCRIPTION OF THE PREFERRED EMBODIMENT

Figure 1:
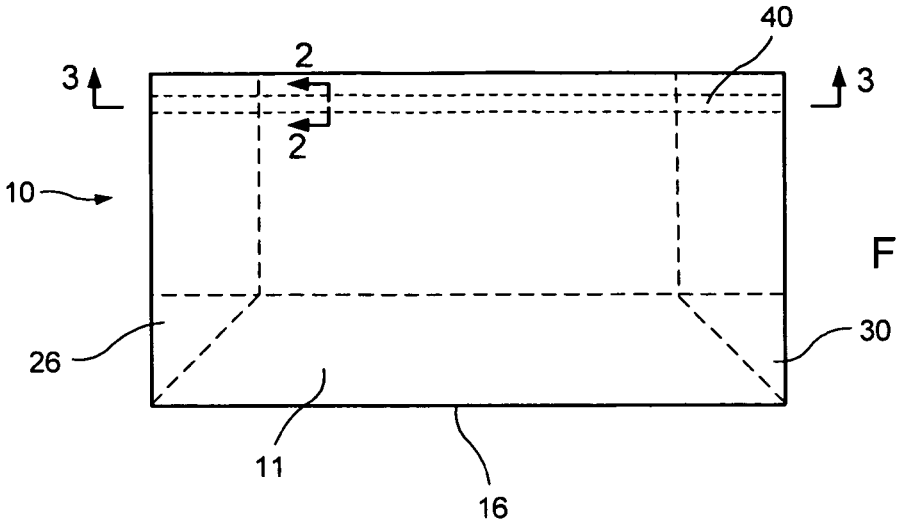
FIG. 1 is a front plan view of the reclosable gusseted bag of the present invention.
Figure 3:
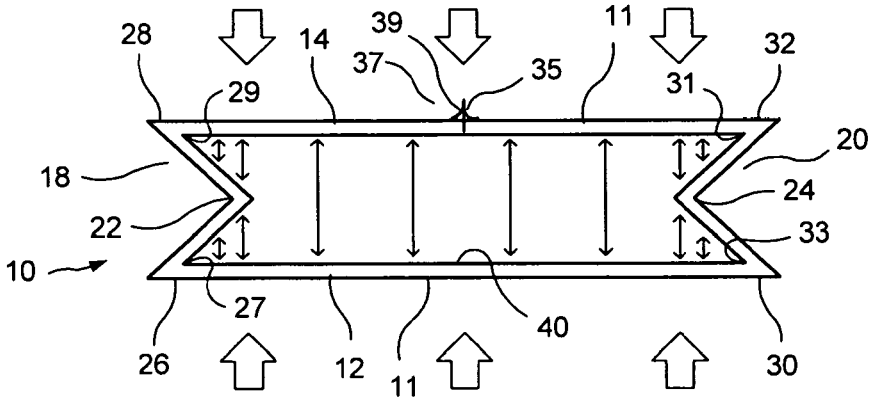
FIG. 3 is a cross-sectional view along plane 3-3 of FIG. 1, showing the single web multiple alignment zipper extending around the periphery of the interior of the partially open mouth of the reclosable gusseted bag of the present invention.
Figure 9:
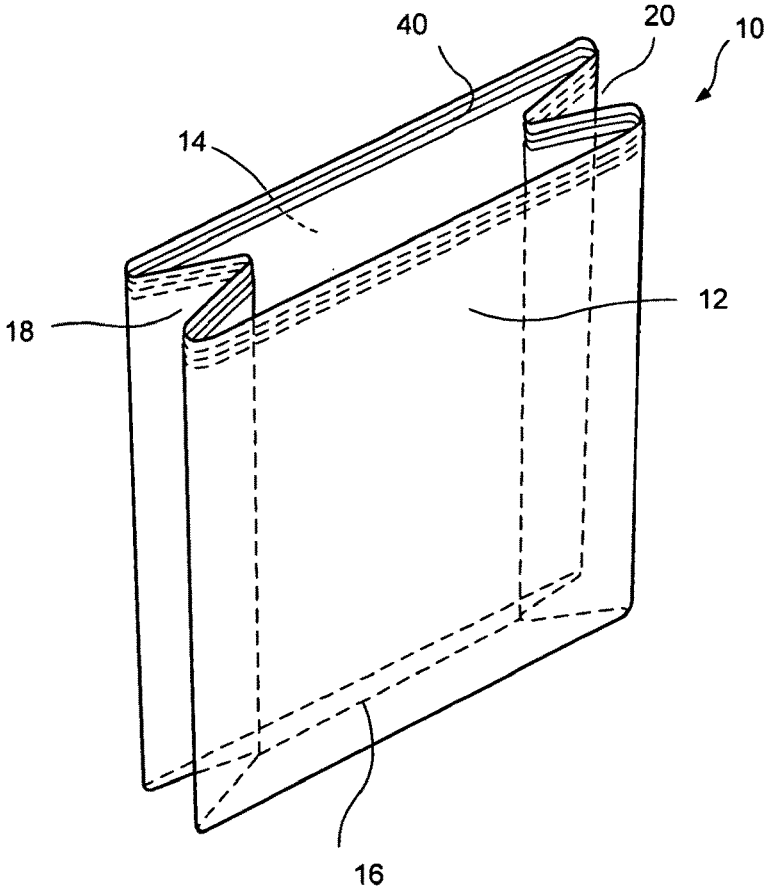
FIG. 9 is a perspective view of the reclosable gusseted bag of the present invention.

Referring now to the drawings in detail wherein like numerals indicate like elements throughout the several views, one sees that FIG. 1 is a front plan view of the reclosable gusseted bag 10 of the present invention, FIG. 3 is a cross-sectional view of the top of reclosable gusseted bag 10 of the present invention and FIG. 9 is a perspective view of the reclosable gusseted bag 10 of the present invention.

The periphery of gusseted bag 10 is typically formed from a single web sheet 11. Single web sheet 11 is formed to include front panel 12, rear panel 14 and left and right gussets 18, 20 formed between panels 12, 14. Panels 12, 14 are sealed together along bottom seal 16 (bottom seal 16 could be a direct seal between the panels 12, 14 or a further gusset could be placed therebetween, particularly if a free-standing bag is desired). Left and right gussets 18, 20 are V-shaped with apices 22, 24.

Apices 22, 24 are formed as folds or creases in single web sheet 11. Similarly, folds or creases 26, 28, 30, 32 are formed in single web sheet 11 as shown in FIG. 3. Lateral edges 33, 35 of web sheet 11 are sealed together by fin seal 37, which protrudes from a central area of rear panel 14.

An alternative embodiment forms the panels 12, 14 and gussets 18, 20 from four separate sheets with seals therebetween in place of creases 26, 28, 30, 32. A further alternative embodiment uses a film tube with the gussets 18, 20 formed therein.

Gussets 18, 20, of course, increase the volume which may be formed between front panel 12 and rear panel 14 when gusseted bag 10 is filled. Gussets 18, 20 further increase the size of the mouth 34 formed between the top edges of front panel 12 and rear panel 14.

Figure 4:
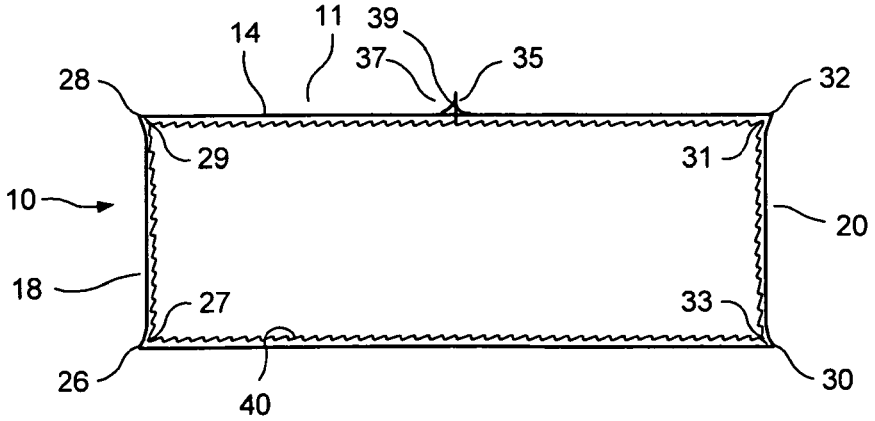
FIG. 4 is a cross-sectional view along plane 3-3 of FIG. 1, showing the reclosable gusseted bag of the present invention in the fully open position.

A single web multiple alignment zipper 40 is sealed to the interior of the periphery of web sheet 11 (thereby including front and rear panels 12, 14 and gussets 18, 20) downwardly adjacent from the top edge thereof which forms mouth 34. The single web multiple alignment zipper 40 extends around the entire interior perimeter of the mouth 34 with the ends of the zipper 40 abutting inwardly from fin seal 37 as shown in FIGS. 3 and 4. Alternatively, in order to reduce manufacturing tolerances for bags which do not require as reliable of a seal formed by zipper 40 (such as, for example, large dry products such as dog food), zipper 40 may extend into fin seal 37 and be crushed therein.

Additionally, as shown in FIG. 3, notches 27, 29, 31, 33 may be cut into single web multiple alignment zipper 40 at the locations of creases 26, 28, 30, 32 in order to facilitate the folding of zipper 40.

Figure 5:
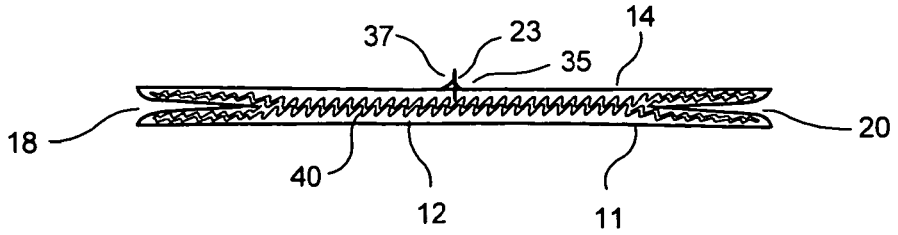
FIG. 5 is a cross-sectional view along plane 3-3 of FIG. 1, showing the reclosable gusseted bag of the present invention in the closed position with the gussets in the internal position.
Figure 6:
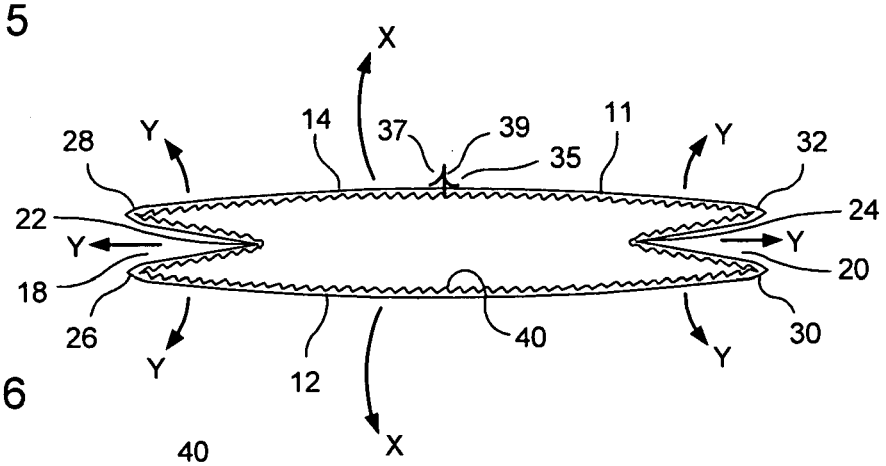
FIG. 6 is a cross-sectional view along plane 3-3 of FIG. 1, showing the forces as the reclosable gusseted bag of the present invention is opened with the gussets in the internal position.
Figure 2:
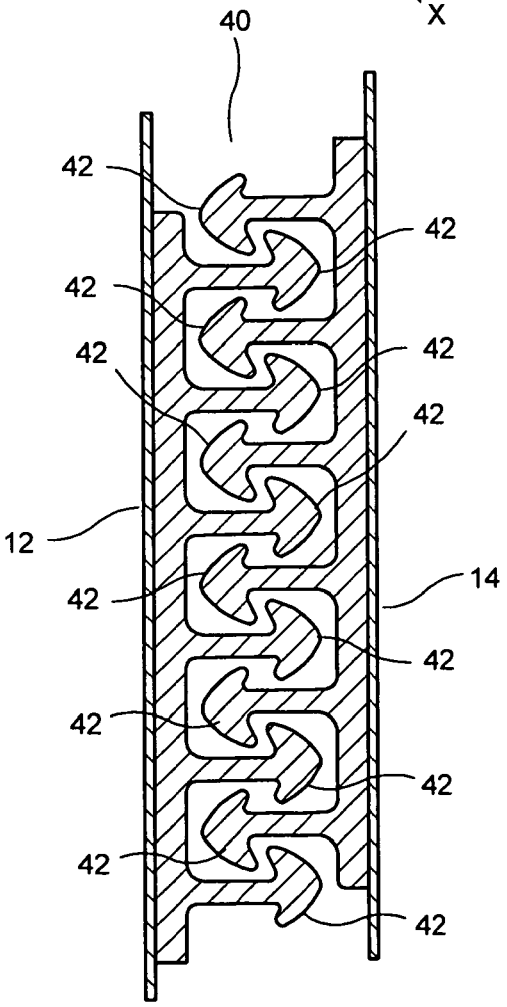
FIG. 2 is a cross-sectional view along plane 2-2 of FIG. 1, showing the single web multiple alignment zipper.
Figure 7:
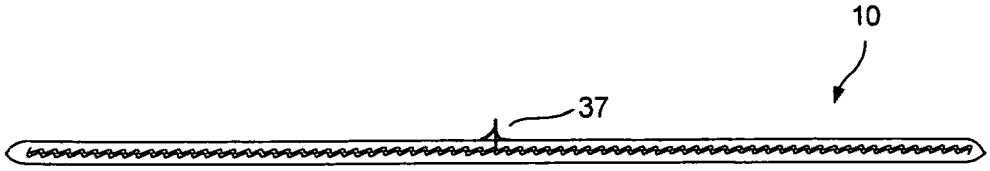
FIG. 7 is a cross-sectional view along plane 3-3 of FIG. 1, showing the reclosable gusseted bag of the present invention in the closed position with the gussets in the external position.
Figure 8:
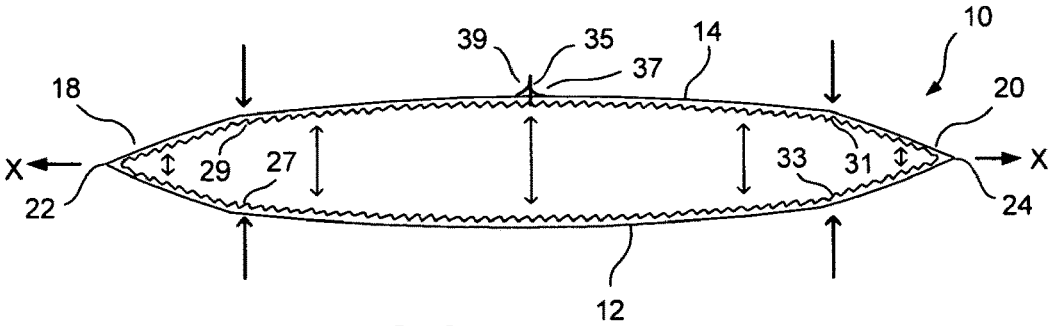
FIG. 8 is a cross-sectional view along plane 3-3 of FIG. 1, showing the forces as the reclosable gusseted bag of the present invention is opened with the gussets in the external position.

FIG. 2 is a cross-sectional view of single web multiple alignment zipper 40 which has been folded upon itself and is shown twice in cross section (that is, a first portion on front panel 12, a second portion on rear panel 14). Such a single web multiple alignment zipper 40 has a plurality (at least two, typically three to five, but perhaps more, such as the six engaging elements illustrated on each portion of the web in FIG. 2) of engaging elements 42 on the whereby a first portion of the single web multiple alignment zipper 40 can align and engage with a second portion thereof in one of a plurality of different configurations throughout a range of alignments. That is, varying the alignment will cause different engaging elements from a first portion of zipper 40 to engage between given engaging elements of an opposing second portion of zipper 40 while resulting in a reliable engagement. In the present configuration, a first portion of the single web multiple alignment zipper 40 on the front panel 12 engages with the portion of the single web multiple alignment zipper 40 on the rear panel 14 as well as respective facing portions of gussets 18, 20 when the gussets are folded in the internal configuration as shown in FIGS. 3, 5 and 6. When the gussets 18, 20 are folded in the external configuration as shown in FIGS. 7 and 8, portions of the zipper 40 on the front portion of gussets 18, 20 engage with portions of zipper 40 on the respective rear portions of gussets 18, 20.

The multiple alignment capability of zipper 40 allows the user to more easily re-engage the zipper 40 after the initial opening of the gusseted bag 10. Single web multiple alignment zipper 40 can be a string zipper (i.e., flangeless) or include one or two flanges.

FIG. 3 shows the contact area encompassing the entire interior perimeter of gusseted bag 10 and the simple force needed to close the gusseted bag 10. FIG. 5 discloses the contact area created when gusseted bag 10 is closed. FIG. 6 shows that when the consumer or user pulls on the front and rear panels 12, 14 thereby exerting force X, the zipper 40 releases around the entire interior perimeter of gusseted bag 10, thereby exerting force Y and releasing the gussets and giving the maximum opening achievable as shown in FIG. 4.

The manufacture of gusseted bag 10 typically includes applying zipper 40 in a transverse direction along single web sheet 11. Web sheet 11 is then dragged over a forming collar (not shown) where various folds 20, 22, 26, 28, 30, 32 are formed thereby forming gussets 18, 20. Lateral edges of web sheet 11 are brought together and fin seal 37 is formed. Bottom seal 16 is formed and the resulting bag 10 is separated from the subsequent bags. Alternately, if the zipper 40 is applied after the gussets 18, 20 have been formed, gussets 18, 20 should typically be in the open or outwardly folded position during application of zipper 40.

Thus the several aforementioned objects and advantages are most effectively attained. Although preferred embodiments of the invention have been disclosed and described in detail herein, it should be understood that this invention is in no sense limited thereby and its scope is to be determined by that of the appended claims.

What is claimed is:

1. A container including:

a front panel and a rear panel;

a first gusset joining a first side of said front panel to a first side of said rear panel;

a second gusset joining a second side of said front panel to a second side of said rear panel;

wherein the front panel, the rear panel and the first and second gussets are formed from a single sheet of material, wherein lateral edges of said single sheet of material are sealed together by a seal;

an opening being formed by an edge of said front and rear panels and said first and second gussets;

a self-mating zipper sealed to an interior of said front and rear panels and said first and second gussets, extending around an entire interior periphery of the container, downwardly adjacent from said opening, the seal maintaining ends of the zipper proximate to each other, the ends of the zipper abutting inwardly from the seal, the self-mating zipper being oriented in a transverse direction along said single sheet of material, ends of the self-mating zipper being proximate to corresponding lateral edges of said single sheet of material;

wherein said self-mating, zipper includes a single web with plurality of engaging track elements parallel to said opening, whereby a first portion of said single web can engage a second portion of said single web in a plurality of different configurations and thereby through a plurality of alignments; and wherein said self-mating zipper provides a first closed position and a second closed position for the container, the first closed position including the first and second gussets folded inwardly and positioned between the front and rear panels, the second closed position including the first and second gussets folded outwardly and extending outwardly from edges of the front and rear panels.

2. The container of claim 1 wherein said front panel, said first gusset, said rear panel and said second gusset are separated by successive folds formed in said single sheet of web, and further wherein said first gusset and said second gusset include central folds therein.

3. The container of claim 1 wherein said plurality of engaging track elements includes at least three engaging track elements.

4. A container including:

a front panel and a rear panel;

a first gusset joining a first side of said front panel to a first side of said rear panel;

a second gusset joining a second side of said front panel to a second side of said rear panel;

wherein the front panel, the rear panel and the first and second gussets are formed from a single sheet of material, wherein lateral edges of said single sheet of material are sealed together by a seal;

an opening being formed by an edge of said front and rear panels and said first and second gussets;

a single self-mating variable alignment multi-track zipper web sealed to an interior of said front and rear panels and said first and second gussets, downwardly adjacent from and parallel to said opening, the seal maintaining ends of the zipper web proximate to each other, the self-mating zipper being oriented in a transverse direction along said single sheet of material, ends of the self-mating zipper being proximate to corresponding lateral edges of said single sheet of material, the ends of the zipper abutting inwardly from the seal; and wherein said self-mating zipper provides a first closed position and a second closed position for the container, the first closed position including the first and second gussets folded inwardly and positioned between the front and rear panels, the second closed position including the first and second gussets folded outwardly and extending outwardly from edges of the front and rear panels.

5. The container of claim 4 wherein said front panel, said first gusset, said rear panel and said second gusset are separated by successive folds formed in said single sheet of web, and further wherein said first gusset and said second gusset include central folds therein.

6. The container of claim 4 wherein said zipper web is a single strip.

7. The container of claim 4 wherein said variable alignment zipper web includes at least three engaging track elements.

8. The container of claim 4 wherein said variable alignment zipper web includes at least six engaging track elements.

9. The container of claim 4 wherein the ends of the zipper are sealed proximate to corresponding lateral edges of the single sheet of material, and wherein at least one end of the zipper extends into the seal.

10. A container including:

a front panel and a rear panel;

a first gusset joining a first side of said front panel to a first side of said rear panel;

a second gusset joining a second side of said front panel to a second side of said rear panel;

wherein the front panel, the rear panel and the first and second gussets are formed from a single sheet of material, wherein lateral edges of said single sheet of material are sealed together by a seal;

an opening being formed by an edge of said front and rear panels and said first and second gussets;

a self-mating zipper sealed to an interior of said front and rear panels and said first and second gussets, extending around an entire interior periphery of the container, downwardly adjacent from said opening, the self-mating zipper being oriented in a transverse direction along said single sheet of material, ends of the self-mating zipper being proximate to corresponding lateral edges of said single sheet of material;

wherein said self-mating zipper includes a single web with a plurality of engaging track elements parallel to said opening, wherein when ends of the self-mating zipper are brought adjacent each other, each of said track elements aligns with itself, whereby a first portion of said single web can engage a second portion of said single web in a plurality of different configurations and thereby through a plurality of alignments; and wherein said self-mating zipper provides a first closed position and a second closed position for the container, the first closed position including the first and second gussets folded inwardly and positioned between the front and rear panels, the second closed position including the first and second gussets folded outwardly and extending outwardly from edges of the front and rear panels.

11. The container of claim 10 wherein said front panel, said first gusset, said rear panel and said second gusset are separated by successive folds formed in said single sheet of web, and further wherein said first gusset and said second gusset include central folds therein.

12. The container of claim 10 wherein said plurality of engaging track elements includes at least three engaging track elements.

13. A container including:

a front panel and a rear panel;

a first gusset joining a first side of said front panel to a first side of said rear panel;

a second gusset joining a second side of said front panel to a second side of said rear panel;

wherein the front panel, the rear panel and the first and second gussets are formed from a single sheet of material;

an opening being formed by an edge of said front and rear panels and said first and second gussets;

a self-mating zipper sealed to an interior of said front and rear panels and said first and second gussets, extending around an entire interior periphery of the container, downwardly adjacent from said opening, wherein spaces are provided between the lateral edges of said sheet and ends of the self-mating zipper, the self-mating zipper being oriented in a transverse direction along said single sheet of material;

wherein said self-mating zipper includes a single web with a plurality of engaging track elements parallel to said opening, wherein when the track elements are positioned adjacent to each other, surfaces of said spaces are brought into contact and sealed to each other in a seal whereby a first portion of said single web can engage a second portion of said single web in a plurality of different configurations and thereby through a plurality of alignments;

wherein said self-mating zipper provides a first closed position and a second closed position for the container, the first closed position including the first and second gussets folded inwardly and positioned between the front and rear panels, the second closed position including the first and second gussets folded outwardly and extending outwardly from edges of the front and rear panels; and the plurality of engaging track elements being attached to and across the single sheet of material so as to form spaces between edges of the single sheet of material and ends of the tracks, wherein when said tracks are positioned in adjacent relationship, surfaces of the spaces are sealed to each other, thereby forming the seal.

14. The container of claim 13 wherein said front panel, said first gusset, said rear panel and said second gusset are separated by successive folds formed in said single sheet of web, and further wherein said first gusset and said second gusset include central folds therein.

15. The container of claim 13 wherein said plurality of engaging track elements includes at least three engaging track elements.

* * * * *